United States Patent [19]

Rosendahl

[11] Patent Number: 4,960,625

[45] Date of Patent: Oct. 2, 1990

[54] WEB-LIKE FILL ELEMENT

[76] Inventor: Gösta Rosendahl, Brännkyrkagatan 68, Stockholm S-11723, Sweden

[21] Appl. No.: 299,963

[22] PCT Filed: Jul. 8, 1987

[86] PCT No.: PCT/SE87/00330

§ 371 Date: Jan. 13, 1989

§ 102(e) Date: Jan. 13, 1989

[87] PCT Pub. No.: WO88/00630

PCT Pub. Date: Jan. 28, 1988

[51] Int. Cl.[5] ..... B32B 1/08; E04B 1/78; B63C 7/12

[52] U.S. Cl. ..... 428/35.3; 428/35.9; 428/69; 428/72; 428/166; 428/178

[58] Field of Search ..... 428/68, 69, 72, 76, 428/166, 178, 192, 43, 198, 35.2, 35.3, 35.8, 35.9

[56] References Cited

U.S. PATENT DOCUMENTS

| | | | |
|---|---|---|---|
| 4,076,872 | 2/1978 | Lewicki et al. | 428/72 |
| 4,262,046 | 4/1981 | Eitel | 428/69 |
| 4,287,250 | 9/1981 | Rudy | 428/198 |
| 4,804,565 | 2/1989 | Rast | 428/69 |
| 4,847,126 | 7/1989 | Yamashiro et al. | 428/178 |

FOREIGN PATENT DOCUMENTS

| | | | |
|---|---|---|---|
| 1054326 | 5/1979 | Canada | 428/72 |
| 1602687 | 2/1971 | France | 428/72 |
| 1212506 | 11/1970 | United Kingdom | 428/72 |

*Primary Examiner*—William J. Van Balen
*Attorney, Agent, or Firm*—Kurt Kelman

[57] ABSTRACT

A web-like element for filling limited space comprises a series of successive gas pockets formed by division of a continuous flexible tubular casing. Each gas pocket contains a given gas volume which does not fill the receptacle volume of the gas pocket completely. The gas may comprise air or nitrogen gas enclosed in a casing of polyethylene. The web-like element comprising gas cushions has great formability for mating up to the walls of the space and adjacent packed parts of the elements, as well as permitting a high degree of filling in the space. The element may be used as buoyancy filling for floating bodies or as insulating filling for spaces in buildings.

8 Claims, 1 Drawing Sheet

WEB-LIKE FILL ELEMENT

The present invention relates to an element for filling limited space, such as the interiors of floating bodies in the form of pontoons and the like, dead space in buildings particularly under roofs, and between ground floor and ground, and in general spaces which are to be filled for buoyancy or insulation with a large number of relative small gas volumes separated from each other. These gas volumes shall fill out the whole space to the greatest possible degree.

Most insulation materials serving to prevent the transport of convection heat are based on the principle of retaining small air pockets in the material. Accordingly, heat transport by gas flow is inhibited. Foamed plastics of varying fabrication and plastics material with more or less hermetic cells have to a great extent come into use as material for insulating against heat transport by convection.

Foamed plastics, e.g. styrene plastics, have also become extensively used for buoyancy in floating bodies. For floating bodies in water there is the particular problem that the buoyance material must have as small a tendency to take up water as possible. Diffusion of moisture into the material through the cell walls must be low.

A general requirement placed on an insulation material or buoyant material for filling relatively large spaces is that the material shall be light and have such mechanical properties that without problems the material can be inserted into spaces, e.g. through a limited opening, and be packed into the space so that a space with complicated configuration is practically filled with the material. Conversely, and in cases where so required, the material should also be able to be taken out from the space without any great problems. This requirement can occur in such cases where the structure forming the space needs to be repaired or where a greater or less amount of the material forming the fill needs to be exchanged for new such material. Finally, the material should be cheap, which is of particular importance, since in many cases it is a question of filling large volumes.

It has been proposed to use light spherical shells of plastics material, e.g. table tennis balls, as buoyant material in pontoons and for lifting sunken shipwrecks. This type of buoyant material is satisfactory in itself from the buoyancy aspect, but has the drawback that for geometrical reasons the space cannot be filled completely and also that the material is relatively expensive. Transporting the material to the place of use will also be complicated and cost demanding, since the whole of the buoyant volume must be transported from the place of manufacture to the place of use. This drawback is naturally applicable to all other buoyant material or insulation material which does not have the advantage of being manufacturable in the immediate vicinity of the place of use.

The object of the invention is to provide a fill element of the kind given in the introduction, which is suitable for filling relatively large spaces for serving as heat insulating or buoyant material, where the element can be inserted into such a space without any problems via an opening of limited size for packing into the space even if the latter has a complicated configuration, where it can be removed from the space without difficulty, where it has low weight and where it can be easily manufactured in a simple mobile plant in the immediate vicinity of the place of use.

This object in accordance with the invention is achieved in that the element is web-like and comprises a series of gas volumes arranged separately and successively, which are each defined by a respective gas pocket of a continous flexible casing divided into gas pockets.

Such a web-like element can be manufactured with the aid of simple known means in a practically unlimited length at a suitable place in the vicinity of the place of use. In such a case the starting material comprises a known tubular plastic casing without gas filling. The casing is supplied and transported in the form of a web wound up on a reel. The web then requires a minor space and can easily be transported. The finished web-like element with its gas-filled pockets in succession one after the other is very flexible to handle and can be easily inserted into the intended space via a relatively small opening, e.g. a manhole on a pontoon or other available openings to a space under a roof or a space between the ground floor and ground or other space in a building where there is a need of heat insulation.

The web-like casing is manufactured conventionally by a continuous gas-filled flexible casing being drawn together at uniform spacing to form mutually isolated gas pockets. In the process of being drawn together opposite peripheral portions of the casing are taken towards each other and welded together along a diagonal through the casing.

For insuring required flexibility and adjustment of the web-like element to the interior contour of the space and to adjacent packed-in web-like elements, thereby to obtain a high degree of filling in the filled volume, the gas pockets contain a gas volume which, with normal air pressure and working temperature, only fill out a given part of the total reception volume of the gas pocket, e.g. 70% to 90% thereof. In this way each individual gas pocket or cushion can more easily adjust itself to the shape of surrounding walls or to other web-like elements.

The gas pockets with gas therein thus form a plurality of gas cushions. The gas cushions usually contain air, but for special purposes it may be suitable to fill them with a fireproof gas such as nitrogen, which can signify improved protection against fire damage to the building in question or in general to the structure surrounding the space.

The initially tubular casing can preferably comprise a plastics material such as polyethylene. The casing may either comprise a single layer or several layers, e.g. three layers. By using a multilayer implementation, there is obtained considerable improvement in the sealing capacity of the casing against diffusion of the inner gas volume through the casing, since the diffusion pressure drop across the casing is divided into several steps with resulting decreased gas passage for a given pressure difference between the inner volume of the gas cushion and the surroundings.

The web-like element can also be made to insulate against radiant heat by having its outside provided with a coating reflecting radiation, e.g. an aluminum coating. This embodiment is especially advantageous in using the element for heat insulation under roof in buildings and between ground floor level and ground, whereby the heat radiation in both directions via the roof and particularly cold radiation from ground can be effectively reduced.

The invention will now be described below with reference to preferred embodiments illustrated in the accompanying drawing.

Figure 1:
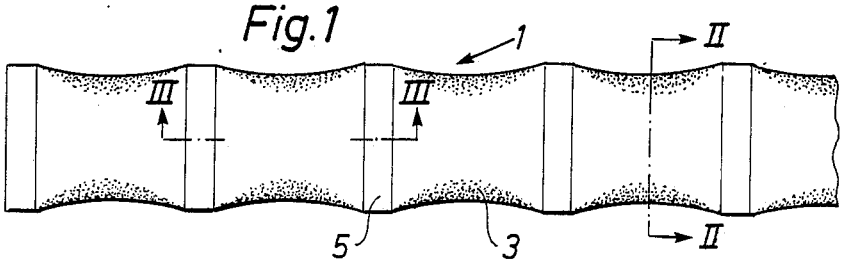
FIG. 1 illustrates a portion of a web-like element in accordance with the invention in plan view.

The web-like fill material in accordance with the invention is denoted by the numeral 1, and comprises a thin flexible casing 4, which is divided into a plurality of successive gas pockets 3 separated by closure portions 5. Each gas pocket 3 contains a given gas volume 2. The gas pockets are separated at uniform spacing by the closure portions 5 formed by the initially tubular gas-filled casing being subjected to a process where opposing halves of the casing periphery are urged towards and joined to each other to form the straight joining portions 5. These opposing portions of the casing are joined to each other conventionally by welding, so that the gas pocket formed hermetically surrounds the respective gas volume 2. The casing 4 preferably comprises polyethylene with a thickness about 0.03 mm.

Plastics material other than polyethylene, e.g. polystyrene or polyurethane, can be used for the casing, but polyethylene is preferred in most cases.

The technique for producing gas cushions of the kind in question here is known per se. The invention applies this technique for producing the new fill element in the form of a web-like element of practically unlimited length and so that these web-like elements can to advantage be used for filling relatively large spaces, defined by different kinds of wall structures, thereby to serve as insulation material or buoyant material in the space. The inventive element allows a very high degree of filling even spaces having a complicated configuration, thereby enabling an effective insulation or high buoyancy as will be more readily apparent hereinafter.

Figure 2:
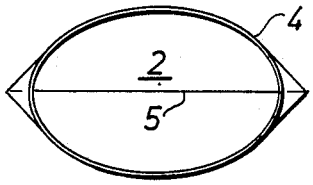
FIG. 2 is a cross section to a larger scale along the line II—II in FIG. 1.

FIG. 2 is a cross section through a gas-filled gas pocket of the web-like element in a free state without extraneous load. The gas pocket is adapted to a normal volume which may vary, depending on the final use of the element. Normally the gas pocket may have a volume of between 0.5 $dm^3$ and 3 $dm^3$, preferably about 1 $dm^3$. For atmospheric pressure and a normal working temperature, the gas enclosed in the pocket has a somewhat smaller volume than the volume of the pocket, i.e. a volume comprising 70% to 90%, preferably 80% of the volume of the pocket. By this incomplete filling of the gas pocket the gas cushion formed is given better adaptability to suit the surroundings, and the web-like elements inserted in the space can easily be adjusted to the walls thereof and to each other when they are packed into the space. The gas introduced into the gas pockets normally may be air, which considerably facilitates and reduces the cost of manufacturing the web-like element.

However, for certain purposes some other gas such as nitrogen may be preferred, particularly in cases where the fill material is to reduce fire risk or in any case to reduce damage occurring as a result of a fire in the structure surrounding the space.

Figure 3:
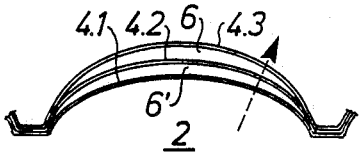
FIG. 3 is a partial longitudinal section to a greater scale along the line III—III in FIG. 1, showing one half of the element casing made in a triple lamination.
Figure 3:
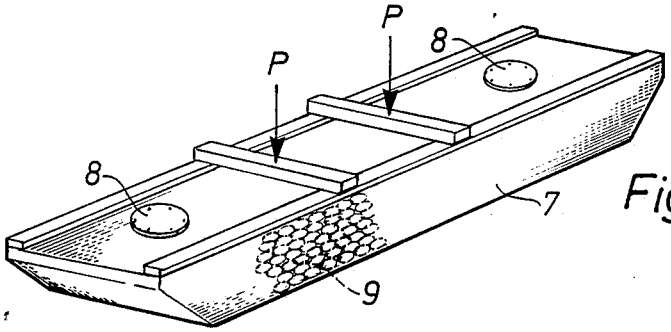

When the fill material is used for buoyancy, the gas can usually be air. In special cases an inert gas can be considered. Irrespective of what gas is used, it is always necessary to take into account a certain amount of diffusion from the volume enclosed by the gas pocket outwards through the casing wall. In order to reduce the gas loss through such diffusion as far as possible, the casing can to advantage comprise a triple laminate such as illustrated in FIG. 3. Here the gas diffuses stepwise through the three layers 4.1, 4.2 and 4.3 of the laminate, with a given pressure drop at each step. An intermediate space 6.6' is formed between two intermediate laminate layers. The division of the total pressure drop into three different diffusion pressure steps reduces the total gas transport through the casing compared with the case for a single layer. The dashed arrow in FIG. 3 illustrates the diffusion direction of the gas volume 2 in the pocket through the casing wall.

To improve the insulating effect of the fill material when it is used as such, the outside of the casing can be coated with a radiation reflecting coating, such as an aluminum coating. In this embodiment the insulating fill material gives very good insulation both for heat transport via convection and heat transport via radiation.

In addition, coating the outside of the casing with such as an aluminum coating further improves the impermeability of the casing. When using a triple laminate of polyethylene the layers included in the laminate may suitably have a thickness of 0.03 mm.

Figure 4:
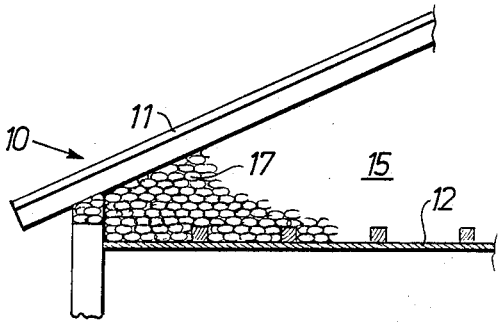
FIG. 4 is a perspective view of a pontoon for a floating bridge with a buoyant filling in accordance with the invention.

FIG. 4 illustrates the invention applied to a pontoon for a pontoon bridge. The pontoon 7 is intended to take up the bridge load denoted by the arrows P, which is transferred via beams to the pontoon fabricated in steel plate. To ensure the buoyancy of the pontoon in case of damage to the plate hull, the interior space of the pontoon is filled with buoyant material 9. The buoyant material comprises web-like fill elements in accordance with the invention, which are inserted via manholes 8 into the interior of the pontoon and are packed into it to a high degree of filling. The web-like material can be inserted through the respective manhole in the form of a single continuous web or possibly divided up into several webs as desired. Packing of elements is adjusted to the desired degree of filling. When there is damage to the pontoon and resulting penetration of water, the buoyancy of the pontoon is only changed to a very small degree, since the buoyant volume introduced in the pontoon is great and is not affected by the moisture which can penetrate into other kinds of buoyant material having a greater tendency to take up water which is usually the case in other materials used conventionally for buoyancy purposes. Even for serious damage by extraneous action on the pontoon it has been found that the main part of the buoyant material has retained sufficient buoyancy to carry the pontoon. If it is desired to remove the buoyant material when the pontoon is inspected, this can be simply achieved by the web-like fill element being once again withdrawn via the respective manhole. This possibility of inserting and once again removing buoyant material in a simple way in accordance with the invention is a very important advantage compared with previously known buoyant material, which has been found to be very difficult to handle in this respect.

Figure 5:
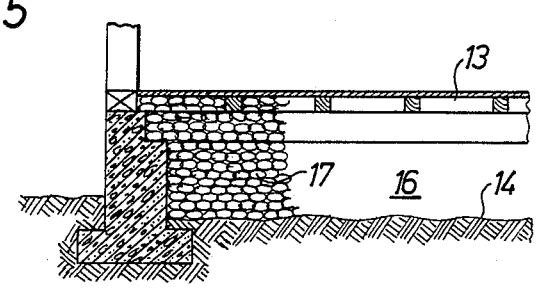
FIG. 5 is a partial vertical section through a building with spaces under the roof and at ground level filled with insulation material in accordance with the invention.

Finally, FIG. 5 illustrates an example of the application of the invention for insulating a building. The building 10 has an attic space 15 not intended for use, between the roof 11 and the ceiling 12. This relatively voluminous and in many places inaccessible space with an irregular configuration can be effectively insulated with the aid of web-like fill elements in accordance with the invention. The Figure is only a partial section of the building showing the left-hand side of the attic space and the space above ground between floor and foundation. A part of the insulating fill material 17, assumed to fill the attic space 15 of the entire building is illustrated to the left in the Figure. This insulating fill material can be inserted in a web-like state via some suitable opening, such as a roof hatch or the like, and be packed into the attic space for filling it to the degree possible. It will be understood that the web-like element, due to its flexibility and good formability, can be brought without difficulty to fill out complicated spaces between ceiling joists, struts etc., with practically complete nestling against the defining parts of the space 15. Here it is a special advantage that the fill material has a low specific weight and thus does not subject the ceiling 12 to any large load.

In order to further improve the insulating effect of the material the outside of the casing 4 can be provided with an aluminum coating, which greatly reduces both incident heat radiation via the roof 11 and departing heat radiation from a heated room under the ceiling 12.

Of particular interest from the fireproofing aspect is the use of nitrogen gas to fill the pockets in the fill element. In case of fire, when the surrounding building construction begins to burn, the nitrogen gas-filled insulation material constitutes an effective obstacle for the spread of fire since the access of air oxygen is restricted.

A similar insulation by web-like fill material is arranged in the foundation space 16 between the bottom floor 13 of the building and the ground 14, as illustrated in the lower part of the figure. This insulation has the particularly advantageous effect of preventing damage to the bottom floor by air circulation which entrains moisture from the ground.

The invention affords a new and advantageous possibility of filling relatively large volumes for buoyancy or insulation. The filling material can to advantage be manufactured at the place of use, whereby expensive transport of voluminous material is eliminated. The filling material in accordance with the invention is very effective for use as buoyant or insulating material, and has a low specific weight, which is of importance in filling relatively large volumes.

I claim:

1. A web-like element for filling limited spaces, which comprises a gas-filled continuous tubular casing having a flexible wall defining opposing halves of an interior peripheral surface and successive closure portions formed by joining and hermetically sealing spaced juxtaposed portions of the opposing halves of the interior peripheral surface to each other, the successive closure portions dividing the web-like element into a continuous series of permanently and hermetically sealed gas pockets defined by the tubular casing wall, the casing wall comprising a laminate of three layers of polyethylene film, each laminate layer having a thickness of 0.03 mm, and an exterior aluminum coating.

2. The web-like element of claim 1, wherein each gas pocket contains a gas volume constituting 70% to 90% of the gas pocket volume at room temperature and atmospheric pressure.

3. The web-like element of claim 2, wherein each gas pocket contains a gas volume constituting 80% of the gas pocket volume at room temperature and atmospheric pressure.

4. The web-like element of claim 1, wherein each gas pocket has a volume of 0.5 to 3 $dm^3$.

5. The web-like element of claim 4, wherein each gas pocket has a volume of 1 $dm^3$.

6. The web-like element of claim 1, wherein the gas is air.

7. The web-like element of claim 1, wherein the gas is an inert gas.

8. The web-like element of claim 7, wherein the inert gas is nitrogen.

* * * * *